US005178475A

United States Patent [19]

Seybold et al.

[11] Patent Number: 5,178,475

[45] Date of Patent: Jan. 12, 1993

[54] RIBBON CASSETTE

[75] Inventors: James M. Seybold, Centerville; Phillip B. Daley, Cincinnati, both of Ohio

[73] Assignee: NCR Corporation, Dayton, Ohio

[21] Appl. No.: 774,461

[22] Filed: Oct. 10, 1991

[51] Int. Cl.[5] ..... B41J 32/00

[52] U.S. Cl. ..... 400/196.1; 400/207

[58] Field of Search ..... 400/196.1, 207, 208, 400/196

[56] References Cited

U.S. PATENT DOCUMENTS

| | | | |
|---|---|---|---|
| 3,974,906 | 8/1976 | Lee et al. | 400/208 |
| 4,209,261 | 6/1980 | Bell et al. | 400/196.1 |
| 4,397,574 | 8/1983 | Wojdyla | 400/196.1 |
| 4,582,439 | 4/1986 | LaSpesa | 400/196.1 |
| 4,611,939 | 9/1986 | Fujiwara | 400/637 |
| 4,616,942 | 10/1986 | Nagasawa et al. | 400/196.1 |
| 4,741,639 | 5/1988 | Fausto et al. | 400/196.1 |
| 4,758,105 | 7/1988 | Nagasawa et al. | 400/195 |

*Primary Examiner*—Edgar S. Burr
*Assistant Examiner*—Anthony H. Nguyen
*Attorney, Agent, or Firm*—George J. Muckenthaler

[57] ABSTRACT

A ribbon cassette has a first tension spring located at an exit port of a cavity of the cassette and a second tension spring located at one corner of the cassette which provides a correct tautness of the ribbon as it travels past the line of printing. The cassette also has a ribbon shield which is positioned relative to printing elements to maintain the ribbon in a straight plane along the line of printing.

9 Claims, 3 Drawing Sheets

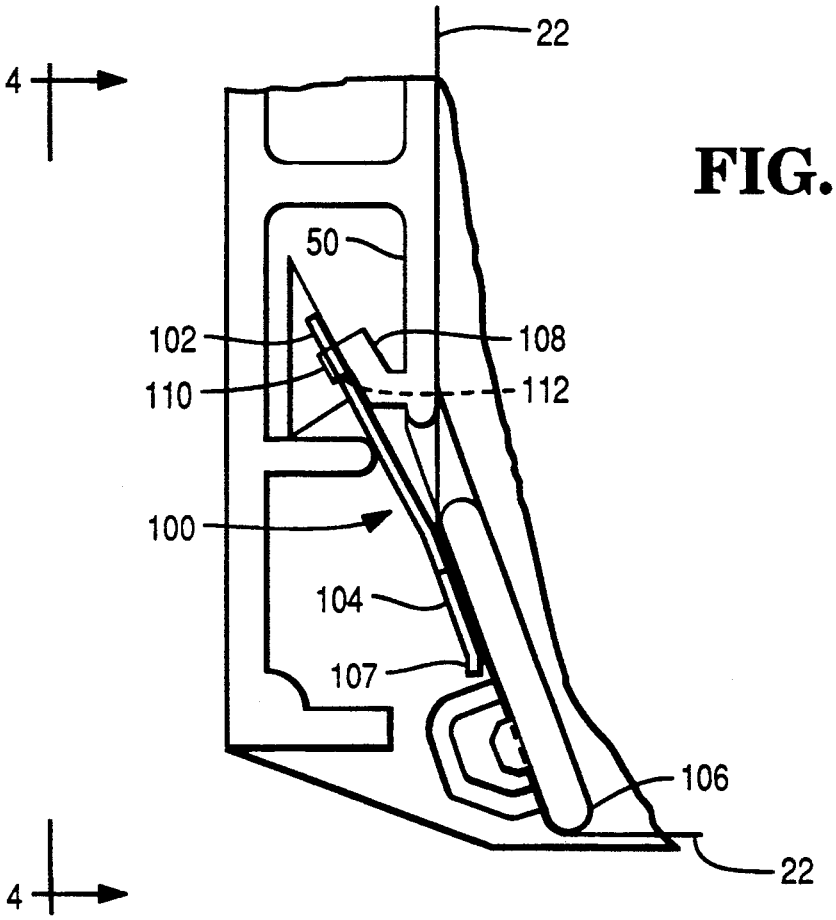
FIG. 3
FIG. 4
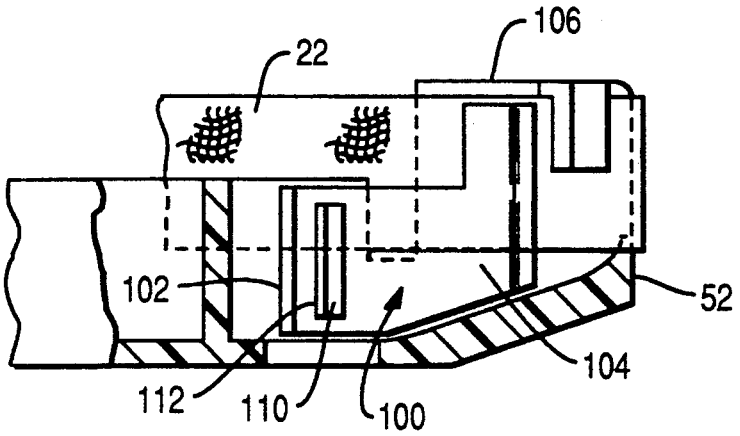

RIBBON CASSETTE

BACKGROUND OF THE INVENTION

In the field of printers, a common part of the printer is a ribbon cassette which is secured to the printer and which contains an endless ribbon. The ribbon is normally contained in a stuffed manner in the body of the cassette and is driven by drive gears out an exit port, along a path adjacent the print head of the printer, and in an entrance port to the cassette body. In this regard, the ribbon is reused by continually driving the ribbon past the print head for millions of printing operations. Such long use of the ribbon is often achieved by training the ribbon at an angle past the print head in order to utilize a greater portion of the ribbon in printing operations.

A common printer that is widely used in the industry is the wire matrix printer which employs a plurality of solenoids normally positioned along a horizontal plane and actuated to drive single wires against the ribbon and the paper or like record media for imparting character images thereon. The use of four such solenoids has provided a printing speed that has been acceptable in many business areas for many years. However, it is seen that with greater demands for better printing quality and higher speed operation, the ribbon cassette needs to be improved to provide the required printing quality and output.

Representative documentation in the ribbon cassette area of printers includes U.S. Pat. No. 4,209,261, issued to D. W. Bell on Jun. 24, 1980, which discloses a ribbon cassette with the ribbon traveling at an angle throughout the cassette.

U.S. Pat. No. 4,616,942, issued to H. Nagasawa et al. on Oct. 14, 1986, discloses a ribbon cassette having a reinking mechanism for extending the life of the ribbon.

U.S. Pat. No. 4,758,105, issued to H. Nagasawa et al. on Jul. 19, 1988, discloses a ribbon cassette having means for maintaining the ribbon in a proper path through the cassette and past the printing station.

SUMMARY OF THE INVENTION

The present invention relates to an improved ribbon cassette. More particularly, the present invention is directed to improvements in ribbon cassettes for purposes of improving printing quality and higher speed operation. The ribbon cassette is designed to provide a structure wherein the ribbon is maintained in a path and in a straight plane, although at an angle, along the printing station and is driven with an increased tension to permit such quality and speed.

In accordance with the present invention, there is provided a ribbon cassette having a body portion for containing a ribbon, an exit port through which the ribbon exits from the body of the cassette, an entrance port through which the ribbon enters the body of the cassette, first and second tension mean for providing desired tension in said ribbon, means for guiding the ribbon from the exit port along a printing station to the entrance port, and means for driving the ribbon past the printing station and along a line of printing, said cassette including shield means secured to said cassette and positioned along the line of printing for shielding said ribbon from record media, the position of said shield means being substantially aligned with a surface of said driving means whereby said ribbon is maintained in a straight plane along said printing station.

In view of the above discussion, a principal object of the present invention is to provide an improved ribbon cassette.

Another object of the present invention is to provide a ribbon cassette having features enabling a higher speed of operation.

An additional object of the present invention is to provide a ribbon cassette that maintains the ribbon in a taut condition along the printing station.

A further object of the present invention is to provide an improved ribbon cassette that includes a shield member adjacent the print head for maintaining the ribbon in a straight plane along the printing station.

Additional advantages and features of the present invention will become apparent and fully understood from a reading of the following description taken together with the annexed drawing.

BRIEF DESCRIPTION OF THE DRAWING

FIG. 3 is an enlarged plan view of the left front portion of the ribbon cassette shown in FIG. 1;

FIG. 4 is an elevational view taken along the line 4—4 of FIG. 3.

DESCRIPTION OF THE PREFERRED EMBODIMENT

Figure 1:
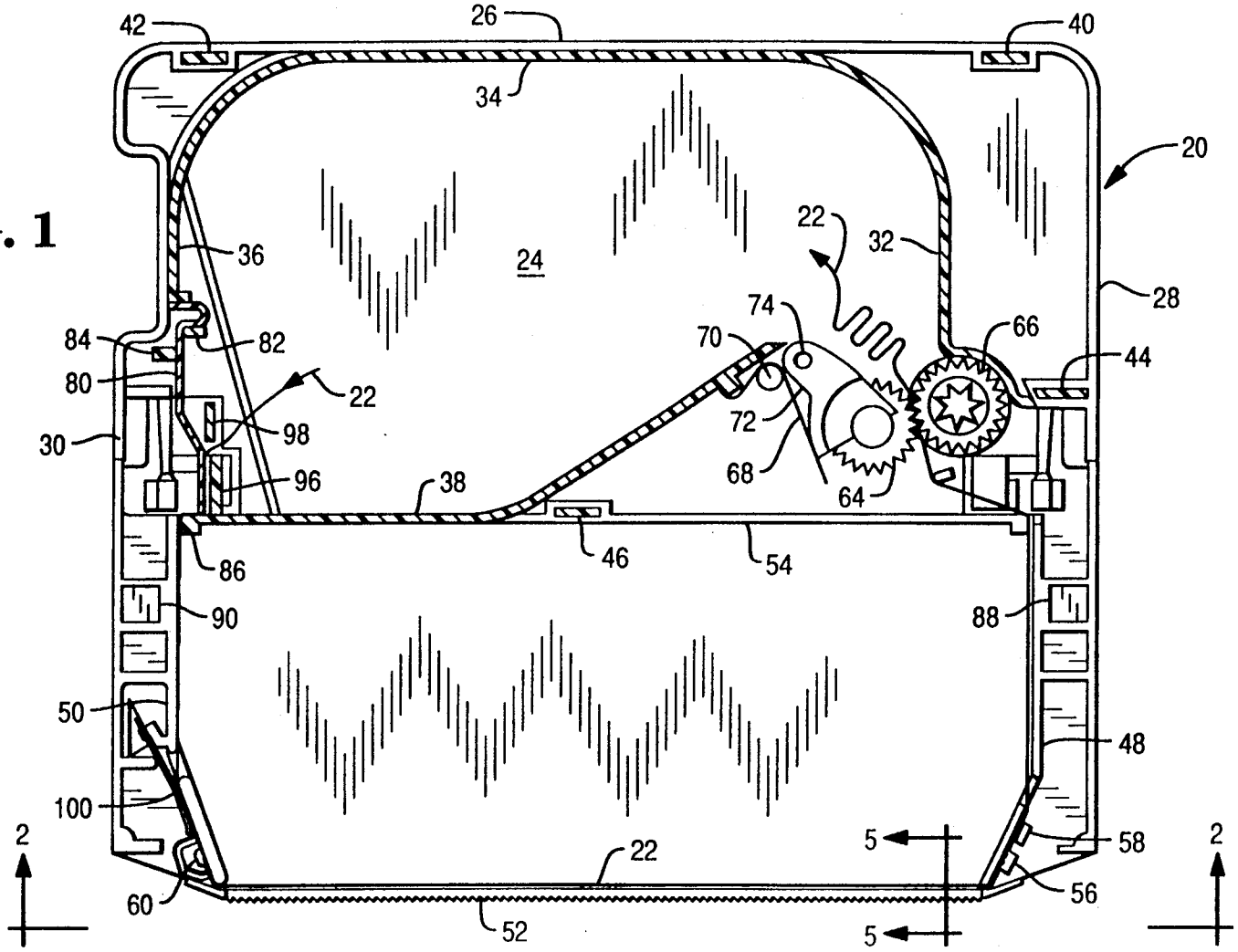
FIG. 1 is a view of a ribbon cassette incorporating the subject matter of the present invention.
Figure 2:
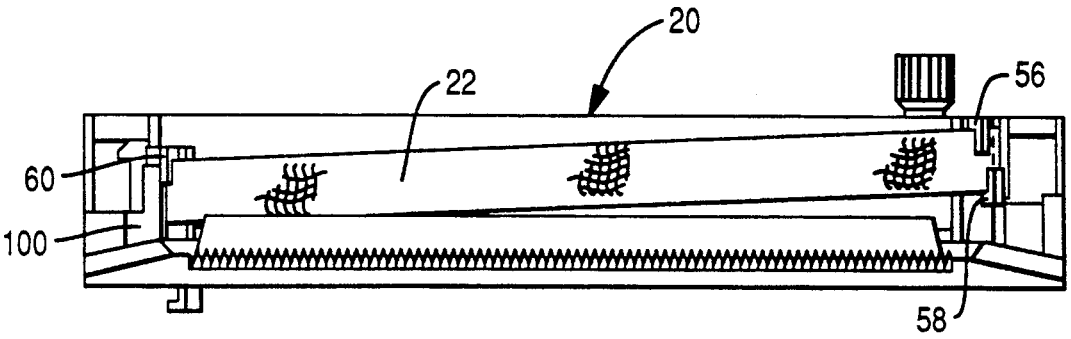
FIG. 2 is an end view of the ribbon cassette shown in FIG. 1.

Referring now to FIGS. 1 and 2, a ribbon cassette, generally designated as 20, is provided to fit on a matrix-type printer (not shown). The cassette 20 is made of molded plastic and takes the shape of a flat case which, in printing operations is connected or latched to the printer frame or enclosure (not shown) by means of latches (not shown). The latches are an integral part of the cassette 20 and are positioned so that the cassette covers the front portion of the printer.

An endless ribbon 22 is contained within the cassette 20 in random manner, also described as a stuffing arrangement, in a cavity 24. FIG. 1 shows a rear view of the cassette 20 with the back cover (not shown) removed therefrom so as to show the several parts of the cassette 20 and the path of the ribbon 22 therethrough. The cassette 20 has an outside wall 26 on the top side thereof, a right hand wall 28 and a left hand wall 30. The cavity 24 is formed by walls 32, 34, 36 and 38 in a manner to contain the endless ribbon 22 which is shown to be driven in a path as indicated by the direction of the ribbon arrows. The walls 26, 28 and 30 are a portion of the front part of the cassette 20, whereas the walls 32, 34, 36 and 38 are a part of the back cover of the cassette and which form the cavity 24. The back cover is connected and locked to the front portion of the cassette 20 by means of lugs 40, 42, 44 and 46 which fit in slots in the front portion of the cassette. A pair of walls 48 and 50 provide guides for the ribbon 22 as the ribbon is driven in a path past a printing station, which is adjacent a front edge 52 of the cassette 20. The portion of the cassette 20 formed by the walls 38, 48, 50 and 54 provides a three-sided enclosure for printing elements (not shown) with the ribbon 22 running along the lower open end of the cassette 20. As seen in FIG. 2, a pair of lugs 56 and 58 on the right side and a lug 60 on the left side also contain the ribbon 22 in its path past the printing area, the ribbon being shown in an inclined or slanted path as directed by the respective lugs.

A pair of identical rollers 64 and 66 are positioned to cooperate with each other in driving the ribbon 22 at an entrance end of the cavity 24 with roller 64 being the driving roller which is pressured against the roller 66 by means of a spring 68. The spring 68 is positioned around a stud 70 secured to the back cover and a plastic arm 72 is pivoted on a pin 74 secured to the same back cover. The plastic arm 72 has secured thereto, as an integral part thereof, a plurality of stripper bearings (not shown) which are positioned between the several driving portions of the roller 64. A first ribbon tension spring 80 is positioned about a stud 82 also fixed to the back cover and abuts a finger 84 and an end portion 86 of the cover, which end portion is an extension of the wall 38.

The cassette body also includes a pair of locating recesses or wells 88 and 90 adjacent the three-sided enclosure formed by the walls 38, 48, 50 and 54 which recesses engage with suitable projections (not shown) to position and hold the cassette 20 on the printer.

A pair of projecting portions 96 and 98 additionally provide positioning means for the spring 80 and also a path for the ribbon 22 to follow from the cavity 24 of the cassette 20 past the spring 80 and toward the printing station.

At the lower left hand corner of the cassette 20 (FIG. 1) is a second tension spring 100 which is secured in a vertical position and which engages the ribbon 22 in a manner to provide additional or increased tautness of the ribbon prior to travel of the ribbon 22 past the front of the cassette. The tension spring 100 is shown in enlarged manner in FIGS. 3 and 4 and includes a rearward portion 102 and a forward portion 104, the portion 104 engaging the ribbon 22 prior to the ribbon turning the corner at an upright portion 106 of the cassette 20 at the left hand side of the line of printing. The forward portion 104 of the tension spring 100 has a bent portion 107 (FIG. 3) for a clean departure of the ribbon 22 from the surface of the spring prior to turning the corner. The cassette 20 includes an angled portion 108 which includes a projection 110 that engages with and fits into an aperture 112 of the spring 100 in the rearward portion 102 and which secures the spring in position on the cassette 20.

Figure 5:
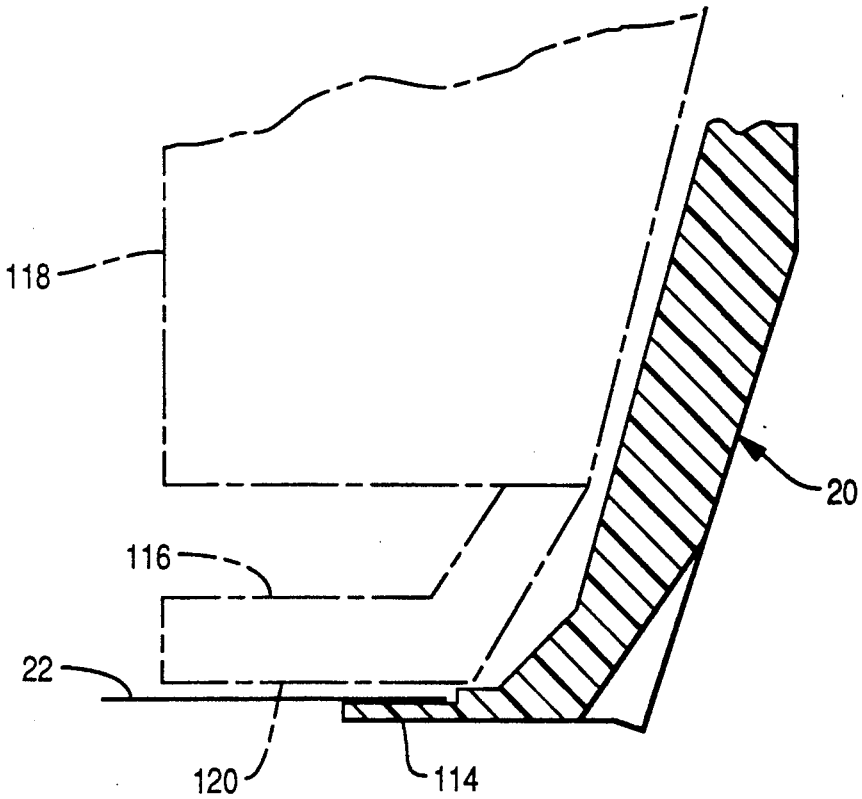
FIG. 5, on the sheet with FIG. 2 is an enlarged view, partly in section, taken along the line 5—5 of FIG. 1.

FIG. 5 shows an elevational view of a portion of the cassette 20 along the line of printing. The ribbon 22 is trained in a path past a ribbon shield 114 and adjacent a carriage portion 116 in an arrangement to maintain the ribbon 22 in a straight plane relative to the shield 114. In this regard, the ribbon 22 is always in a position to be impacted by a printing element or elements, as 118, at a precise location relative to the paper or like record media. A front surface 120 of the printing element 118 is located in a position relative to the ribbon shield 114 to maintain the ribbon in a taut and straight plane.

It is thus seen that herein shown and described is a ribbon cassette which is removable from the printer and whereon the ribbon is caused to be driven in a path from a cavity of the cassette at an angle past the printing station. The ribbon is tensioned by a first tension member at the exit of the cavity and is tensioned by a second tension member at the one corner of the cassette just prior to traveling past the line of printing. The first tension member and the second tension member provide for a correctly taut ribbon in a path along the line of printing for exceptional printing quality and long life of the ribbon. A ribbon shield on the cassette is positioned relative to a printing element to maintain the ribbon in a straight plane along the printing station.

The cassette of the present invention enables the accomplishments of the objects and the advantages mentioned above and while a preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A ribbon cassette having an endless ribbon for use on a printer having at least one printing element, said ribbon cassette comprising a body portion having a cavity for containing the ribbon in random manner, roller means supported from the body portion for continuously driving the ribbon into an entrance port of said cavity and out of said cavity at an exit port and along a path at an angle across the front of the cassette, first tension means positioned at the exit port for maintaining the ribbon in a taut condition prior to leaving the cavity, and second tension means positioned beyond the exit port and comprising a spring member having a rearward portion and a forward portion, said cassette having an angled portion with an elongated projection thereon and said rearward portion of said spring member having an elongated aperture therein for fitting on said projection and securing said spring member to said cassette and said cassette having an upright portion at one corner thereof and said forward portion of said spring member having an upwardly extending portion adjacent said upright portion of said cassette and engageable with said ribbon and urging said ribbon against said upright portion of said cassette for maintaining the ribbon in a taut condition across the front of the cassette.

2. The ribbon cassette of claim 1 wherein said first tension means comprises a leaf spring secured at the exit port of said cavity.

3. The ribbon cassette of claim 1 wherein said second tension means comprises a leaf spring secured adjacent the exit port of said cavity.

4. The ribbon cassette of claim 1 wherein said second tension means comprises a leaf spring defining an aperture therein and said body portion includes a projection protruding through said aperture for securing said leaf spring.

5. In a ribbon cassette for an endless ribbon for sue on a printer having at least one printing element, the improvement comprising a cavity for containing said ribbon in random manner and having an entrance port and an exit port for directing said ribbon along a line of printing, first tension means positioned at the exit port for tensioning the ribbon prior to leaving the cavity, and second tension means positioned beyond the exit port and comprising a spring member having a rearward portion and a forward portion, said cassette having an angled portion with an elongated projection thereon and said rearward portion of said spring member having an elongated aperture therein for fitting on said projection and securing said spring member to said cassette and said cassette having an upright portion at one corner thereof and said forward portion of said spring member having an upwardly extending portion adjacent said upright portion of said cassette and engageable with said ribbon for urging said ribbon against said upright portion of said cassette for increasing the tension of said ribbon along the line of printing.

6. In the ribbon cassette of claim 5 wherein the first tension means comprises a leaf spring of elongated shape secured to one side of said cassette adjacent the exit port of said cavity.

7. In the ribbon cassette of claim 5 wherein the second tension means comprises a leaf spring of planar shape secured to one side of said cassette adjacent the exit port of said cavity.

8. In the ribbon cassette of claim 5 wherein said ribbon cassette includes a projection adjacent the exit end of said cavity and said second tension means comprises a leaf spring and defines an aperture therein for receiving said projection for securing said leaf spring.

9. In the ribbon cassette of claim 5 wherein the cassette includes a ribbon shield thereon secured to said cassette and extending along said line of printing and adjacent a front surface of said printing element and positioned for maintaining the ribbon in a taut condition and in a straight plane along said line of printing.

* * * * *

UNITED STATES PATENT AND TRADEMARK OFFICE

CERTIFICATE OF CORRECTION

PATENT NO. : 5,178,475

DATED : January 12, 1993

INVENTOR(S) : James M. Seybold et al.

It is certified that error appears in the above-identified patent and that said Letters Patent is hereby corrected as shown below:

Column 4, line 54, delete "sue" and substitute --use--.

Signed and Sealed this

Thirtieth Day of November, 1993

*Attest:*

*Attesting Officer*

BRUCE LEHMAN

*Commissioner of Patents and Trademarks*